US005846124A

United States Patent [19]

Rokutanda et al.

[11] Patent Number: 5,846,124

[45] Date of Patent: Dec. 8, 1998

[54] CENTRIFUGAL ABRASIVE GRAIN PROJECTING DEVICE

[75] Inventors: Hitoshi Rokutanda; Hiroaki Suzuki; Toshio Shinke, all of Toyokawa, Japan

[73] Assignee: Sintokogio, Ltd., Nagoya, Japan

[21] Appl. No.: 718,501

[22] PCT Filed: Feb. 1, 1996

[86] PCT No.: PCT/JP96/00200

§ 371 Date: Nov. 26, 1996

§ 102(e) Date: Nov. 26, 1996

[87] PCT Pub. No.: WO96/23629

PCT Pub. Date: Aug. 8, 1996

[30] Foreign Application Priority Data

Feb. 3, 1995 [JP] Japan ..... 7-039344

[51] Int. Cl.[6] ..... B24C 5/06

[52] U.S. Cl. ..... 451/95; 451/97

[58] Field of Search ..... 451/94, 95, 97, 451/98

[56] References Cited

U.S. PATENT DOCUMENTS

| | | | |
|---|---|---|---|
| 4,329,819 | 5/1982 | May | 451/95 |
| 4,336,672 | 6/1982 | Kwolek | 451/95 |
| 4,447,993 | 5/1984 | Laido | 451/98 |
| 4,565,035 | 1/1986 | Carpenter et al. | 451/95 |
| 4,680,899 | 7/1987 | Carpenter et al. | 451/92 |
| 5,024,028 | 6/1991 | Pierce et al. | 451/95 |
| 5,209,024 | 5/1993 | Carpenter et al. | 451/95 |

FOREIGN PATENT DOCUMENTS

| | | | |
|---|---|---|---|
| 57-140963 | 9/1982 | Japan | B24C 5/06 |
| 62-150057 | 9/1987 | Japan | B24C 5/06 |

*Primary Examiner*—Eileen P. Morgan
*Attorney, Agent, or Firm*—Limbach & Limbach L.L.P.

[57] ABSTRACT

A centrifugal abrasive grain projecting device is disclosed. The device includes a cover main body (2) covering an impeller (1), a hollow cylindrical body (6) rotatably mounted on the external surface of a side wall of the cover main body, a control cage (7) passing through the cylindrical body so as to be inserted into the impeller and at one end detachably affixed to the hollow cylindrical body, an introducing tube (9) that is adapted to abut, at a distal end, one end of the control cage via an elastic member (8) and that is detachably held between the control cage and a holding mechanism (10), and a rotational drive mechanism (17) for reversibly rotating the hollow cylindrical body, wherein the device prevents abrasive grains from entering a portion where the hollow cylindrical body fits in the cover main body and from stopping the rotation of the hollow cylindrical body. In the device the control cage is rotatably mounted on the hollow cylindrical body via a rolling bearing (5), and a rolling body **(5*a*) of the rolling bearing is closed on the impeller side by a liner (15) via a filler member (14) and closed on the introducing tube side by a bearing cover (23) via a filler member (22)**.

3 Claims, 4 Drawing Sheets

CENTRIFUGAL ABRASIVE GRAIN PROJECTING DEVICE

TECHNICAL FIELD

This invention relates to an improvement of a centrifugal abrasive grain projecting device.

BACKGROUND ART

In some shot-blasting operations to abrade steel plate or other products, the direction in which grains are to be projected must be changed because of changes in the widths or positions of the products. A centrifugal abrasive grain projecting device that is suitable for such operations is disclosed in Japanese Utility Model KOKAI 57-140963 (JP 57-140963, U). The apparatus includes a cover main body covering an impeller, a short, hollow cylindrical body having an axis perpendicular to and rotatably mounted on the external surface of a side wall of the cover main body, a control cage passing through the hollow cylindrical body so as to be inserted into the impeller and that is detachably affixed to the hollow cylindrical body at one end thereof, an introducing tube that is adapted to abut, at a distal end, one end of the control cage via an annular elastic member and that is detachably held between the control cage and a holding mechanism, and a rotational drive mechanism for reversibly rotating the hollow cylindrical body, wherein the direction in which the abrasive grains are projected can be changed by reversibly rotating the control cage via the cylindrical body.

However, in the conventional abrasive grain projecting device of the structure as mentioned above grains enter a portion where the hollow cylindrical body fits in the cover main body, thereby impairing the rotation of the hollow cylindrical body. Thus the device has not been actually realized.

This invention is conceived in light of this fact. It aims to provide an improved abrasive grain projecting device that eliminates the drawback wherein abrasive grains enter the portion where the hollow cylindrical body fits in the cover main body and prevent the hollow cylindrical body from rotating.

DISCLOSURE OF INVENTION

To the above end, the centrifugal abrasive grain projecting device of the present invention includes a cover main body covering an impeller, a short, hollow cylindrical body having an axis perpendicular to and rotatably mounted on the external surface of a side wall of the cover main body, a control cage passing through the hollow cylindrical body so as to be inserted into the impeller and detachably affixed to the hollow cylindrical body at one end thereof, an introducing tube adapted to abut, at a distal end, one end of the control cage via an annular elastic member and that is detachably held between the control cage and a holding mechanism, and a rotational drive mechanism for reversibly rotating the hollow cylindrical body, characterized in that the control cage is rotatably mounted on the hollow cylindrical body via a rolling bearing, and that a rolling body of the rolling bearing is closed on the impeller side by a liner via a filler member and closed on the introducing tube side by a bearing cover via a filler member.

Since the device is thus structured, the liner, bearing cover, and filler members prevent abrasive grains from entering the rolling body of the rolling bearing.

BEST MODE FOR CARRYING OUT THE INVENTION

Figure 1:
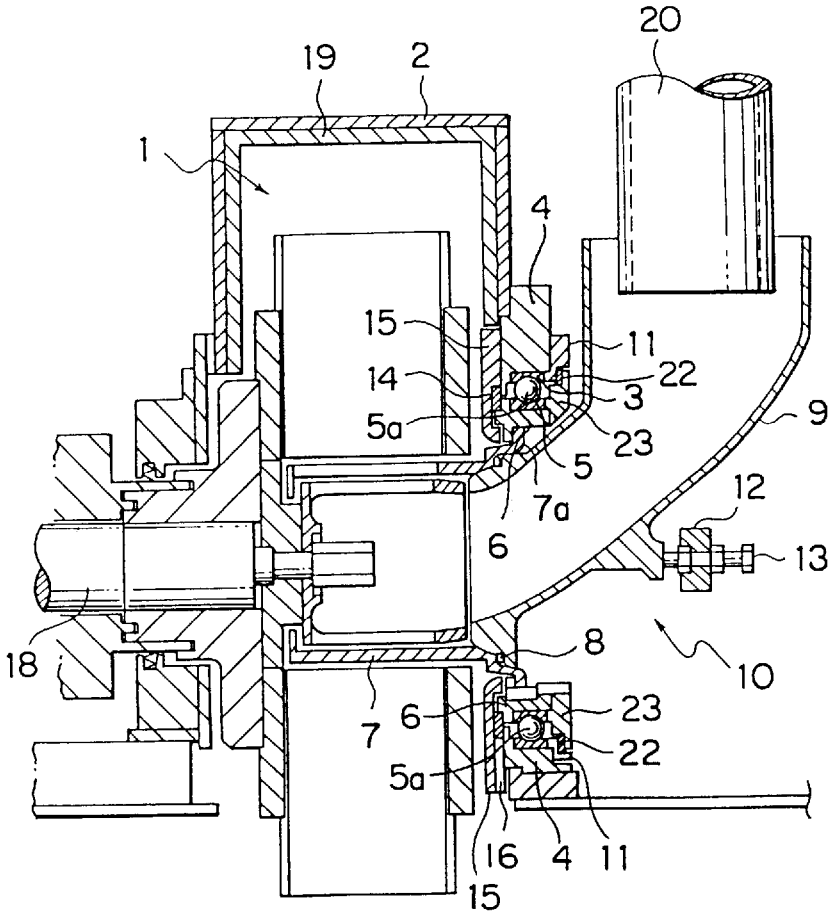
FIG. 1 is a front view partly in cross section of the first embodiment of the device of the present invention.

The first embodiment of the present invention will now be explained in detail by reference to the drawings. As in FIG. 1, which is partly in cross section, an auxiliary cover 4 having a central hole 3 is mounted on a right-side external surface of a cover main body 2 which covers an impeller 1. A rolling bearing 5 is fitted in the central hole 3 between an upper and lower race. A short, hollow cylindrical body 6 is fitted in the rolling bearing 5. The cylindrical body 6 has an axis perpendicular to an external surface of a side wall of the cover main body 2 and is rotatable about the axis.

A control cage 7, which passes through this hollow cylindrical body 6, and which is inserted in the impeller 1, is fitted in the hollow cylindrical body at a right end thereof. Further, a collar portion 7*a* of the control cage 7 detachably engages the hollow cylindrical body 6. The left end of an introducing tube 9 contacts the right end of the control cage 7 via an annular elastic body 8 made of rubber. The introducing tube 9 is detachably held between the control cage 7 and a holding mechanism 10. As in FIG. 2, which is a right side view, the holding mechanism 10 is comprised of a supporting member 12 extending rightward and leftward and attached to the auxiliary cover 4 via a holding member 11 mounted on the right end of the hollow cylindrical body 6, and a plurality of bolts 13, 13 (FIG. 1) threaded into the supporting member 12.

Further, as in FIG. 1, an annular filler member 14 is mounted on the left side of a rolling body 5*a* of the rolling bearing 5 to cover an inner gap between the upper and lower races. The filler member 14 is produced by combining felt or metal fibers and has some contraction and expansion properties. The filler member 14 is pressed and supported by a liner 15 attached to the left surface of the auxiliary cover 4. Further, a filler member 22 made of similar material and having properties similar to the filler member 14 is also mounted on and pressed by a bearing cover 23 against the right side of the rolling body 5*a* of the rolling bearing 5 to cover an outer gap formed between the upper and lower races. A depression 16 is formed in a lower part of the liner 15, so that even if abrasive grains enter between the liner 15 and hollow cylindrical body 6 at their upper portions, these grains drop via the depression 16. The depression 16 may be eliminated depending on the kind (material, sizes) of grains.

In the drawings, number 17 denotes a cylinder that rotates the hollow cylindrical body 6, number 18 a drive shaft that supports and rotates the impeller, 19 a cover liner, and 20 an abrasive grain feeding tube.

In the operation the impeller 1 is rotated by the drive shaft 18 to centrifugally project abrasive grains, and the control cage 7 and introducing tube 9 are reversibly rotated by the protrusion and retraction of the cylinder 17 via the hollow cylindrical body 6 and elastic body 8 to change the direction of grains to be projected. This operation is quite the same as that of the conventional device. However, the liner 15, bearing cover 23, and filler member 14 prevent the abrasive grains from entering the rolling body 5*a* of the rolling bearing 5.

Figure 2:
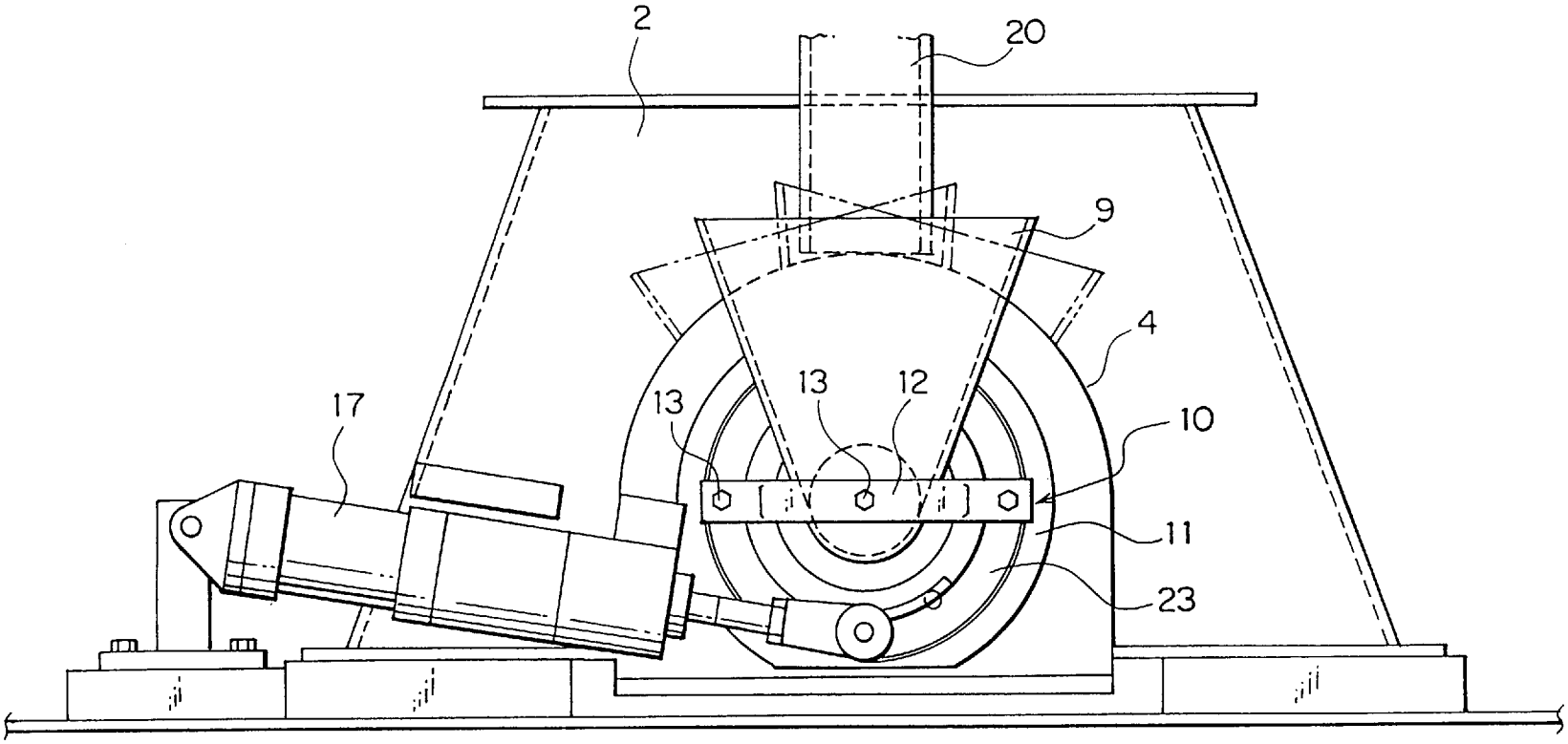
FIG. 2 is an elevational view from the right of the device of FIG. 1.
Figure 3:
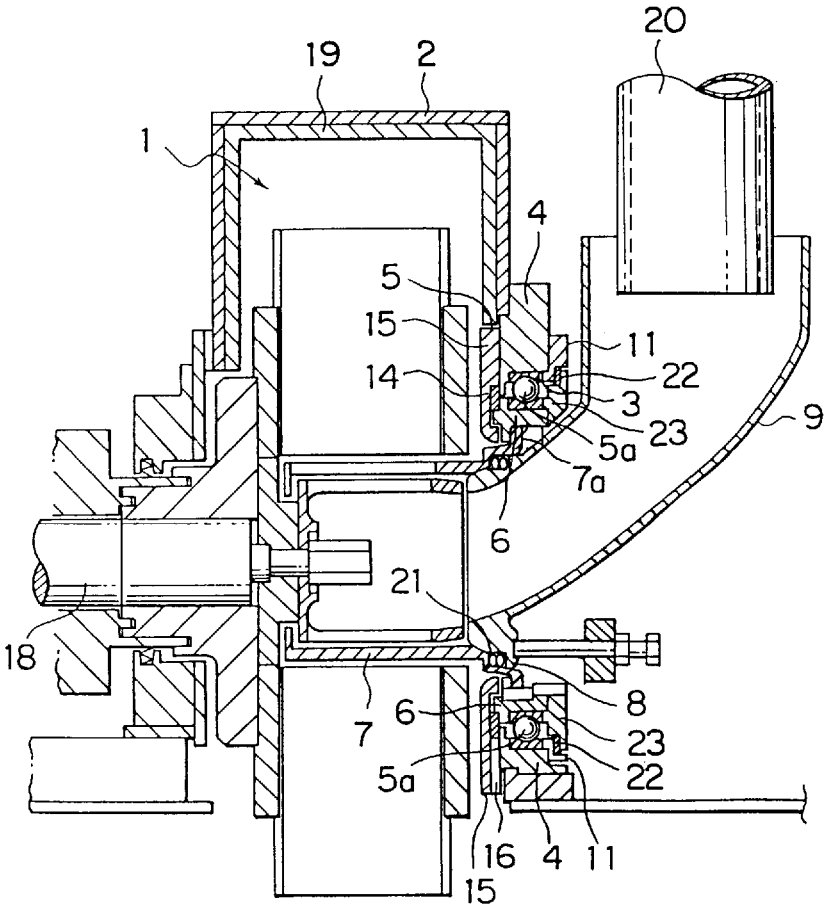
FIG. 3 is a front view partly in cross section of the second embodiment of the device of the present invention.
Figure 4:
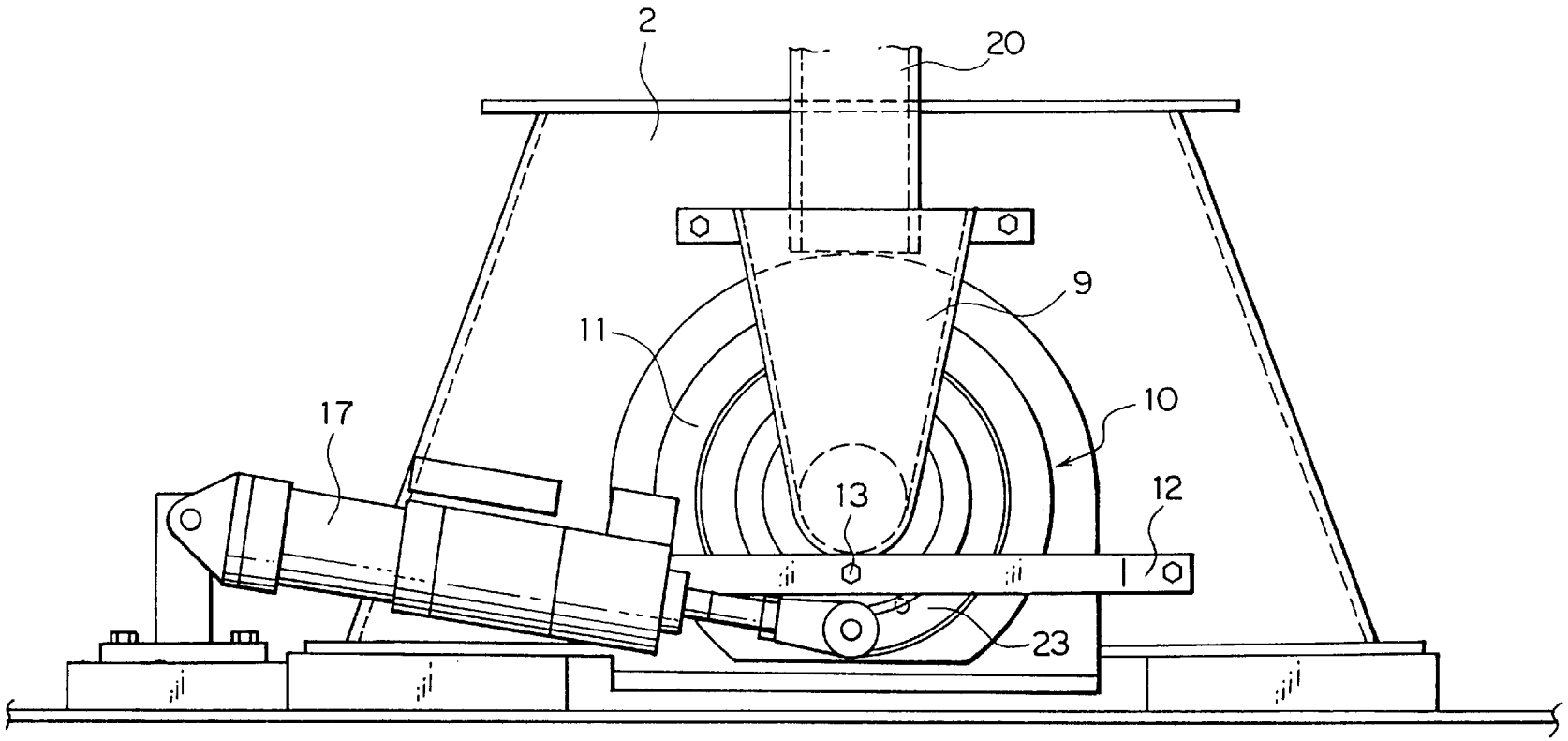
FIG. 4 is an elevation view from the left of the device of FIG. 1.

In the first embodiment, to lessen the wear of the elastic member 8 made of rubber or the like, which wear is caused by the control cage 7 slipping relative to the introducing tube 9, the introducing tube 9 is reversibly rotated through an angle (as shown by imaginary lines in FIG. 2). However, as in FIGS. 3 and 4, which are a front view partly in cross section and a right side view, respectively, a slip member 21 made of a hard and wear-resistant metal, ceramic, or the like and having a smooth surface, may be disposed beside the left side of the elastic member 8, and the introducing tube 9 may be fixed on the cover main body, thereby allowing the control cage to rotate and slip on the smooth surface of the slip member 21. In this case, the elastic member 8 is desirably made of felt or metal fibers or the like. Further, the support member 12 of the holding mechanism 10 is fixed to the cover main body 2.

In the second embodiment one slip member 21 is used. However, two or more slip members may be used, allowing slip contact therebetween.

Industrial Applicability

As is clear from the above description, since the device of the invention includes a cover main body covering an impeller, a short, hollow cylindrical body having an axis perpendicular to and rotatably mounted on the external surface of a side wall of the cover main body, a control cage passing through the hollow cylindrical body so as to be inserted into the impeller and detachably affixed to the hollow cylindrical body at one end thereof, an introducing tube that is adapted to abut, at a distal end, one end of the control cage via an annular elastic member and that is detachably held between the control cage and a holding mechanism, and a rotational drive mechanism for reversibly rotating the hollow cylindrical body, wherein the control cage is rotatably mounted on the hollow cylindrical body via a rolling bearing, and wherein a rolling body of the rolling bearing is closed on the impeller side by a liner via a filler member and closed on the introducing tube side by a bearing cover via a filler member, the liner, bearing cover, and filler member prevent abrasive grains from entering the portion where the hollow cylindrical body fits in the cover main body. Thus the drawback in which the hollow cylindrical body cannot rotate due to the abrasive grains clogging the portion is eliminated. Thus this invention has industrial applicability.

We claim:

1. A centrifugal abrasive grain projecting device, comprising:

an impeller:

a cover covering the impeller so that the impeller is free to rotate within the cover, said cover having a side wall;

a rolling bearing mounted on the side wall of the cover, wherein the rolling bearing has races, with an inner gap and an outer gap between the races, said inner gap facing the impeller;

a short, hollow cylindrical body mounted on the rolling bearing so as to be rotatable relative to the side wall of the cover;

a control cage passing through the hollow cylindrical body so as to extend within said impeller, one end of the control cage being detachably affixed to the hollow cylindrical body;

an annular elastic member;

an introducing tube for introducing abrasive grains, wherein the introducing tube has a distal end connected to said one end of the control cage, with the annular elastic member between the distal end of the introducing tube and said one end of the control cage;

means for reversibly rotating the hollow cylindrical body, thereby rotating the control cage;

means for covering the inner gap between the races of the rolling bearing; and means for covering the outer gar between the races of the rolling bearing.

2. The device of claim 1, further including an annular slip member inserted together with the annular elastic member between said one end of the control cage and the distal end of the introducing tube.

3. The device of claim 1, wherein the rolling bearing includes a rolling body supported by the races, and the means for covering the inner gap includes:

a liner mounted to the cover; and a filler member supported by the liner.

* * * * *

UNITED STATES PATENT AND TRADEMARK OFFICE

CERTIFICATE OF CORRECTION

PATENT NO.: 5,846,124
DATED: December 8, 1998
INVENTOR(S): HITOSHI ROKUTANDA ET AL.

It is certified that an error appears in the above-identified patent and that said Letters Patent is hereby corrected as shown below:

Column 4, line 30, "gar" should be --gap--.

Signed and Sealed this

Thirtieth Day of March, 1999

*Attest:*

Q. TODD DICKINSON

*Attesting Officer*

*Acting Commissioner of Patents and Trademarks*